US006561962B1

(12) United States Patent
Engelhart

(10) Patent No.: US 6,561,962 B1
(45) Date of Patent: May 13, 2003

(54) LINE PLASTIC BAG MACHINE

(75) Inventor: William Michael Engelhart, Bartlett, IL (US)

(73) Assignee: Converting Systems, Inc., Addison, IL (US)

( * ) Notice: Subject to any disclaimer, the term of this patent is extended or adjusted under 35 U.S.C. 154(b) by 0 days.

(21) Appl. No.: 09/522,847

(22) Filed: Mar. 10, 2000

(51) Int. Cl.[7] ..... B31B 1/64

(52) U.S. Cl. ..... 493/199; 493/197; 493/205; 493/228

(58) Field of Search ..... 493/186, 189, 493/205, 197, 228, 240, 11

(56) References Cited

U.S. PATENT DOCUMENTS

| | | | | |
|---|---|---|---|---|
| 3,994,209 | A | | 11/1976 | Jacob |
| 4,003,298 | A | | 1/1977 | Schott, Jr. |
| 4,011,978 | A | | 3/1977 | Lehmacher et al. |
| 4,077,306 | A | | 3/1978 | Wech |
| 4,735,675 | A | * | 4/1988 | Metz |
| 4,934,993 | A | * | 6/1990 | Gietman, Jr. |
| 5,165,221 | A | | 11/1992 | Udelson et al. |
| 5,230,688 | A | * | 7/1993 | Hatchell et al. |
| 5,390,875 | A | | 2/1995 | Gietman, Jr. et al. |
| 5,447,486 | A | * | 9/1995 | Anderson et al. |
| 5,638,268 | A | | 6/1997 | Souza |
| 5,660,674 | A | | 8/1997 | Saindon et al. |
| 5,695,106 | A | * | 12/1997 | Bauknecht |
| 5,738,618 | A | | 4/1998 | Lemerand et al. |
| 5,746,043 | A | | 5/1998 | Terminella et al. |
| 5,792,306 | A | | 8/1998 | Verbeiren |
| 5,833,107 | A | | 11/1998 | Terranova et al. ..... 226/31 |
| 6,004,252 | A | | 12/1999 | Blaser |

OTHER PUBLICATIONS

"Its in the Bag", David Martino and Kenneth Baker, Baker Motion Control Systems, Inc., Jul./Aug. 1995, pp. 19–22.

* cited by examiner

*Primary Examiner*—Eugene Kim
(74) *Attorney, Agent, or Firm*—Thomas R. Vigil; Welsh & Katz, Ltd.

(57) ABSTRACT

The line plastic bag machine comprises: first and second side walls; a plurality of rollers mounted between the side walls for receiving a web of plastic film that is trained through the machine over and around the rollers; a main drive motor; a main drive shaft driven by the main drive motor; the rollers including a main drive or chrome roller and a pair of spaced apart shuttle rollers mounted in a shuttle assembly; a drive train for driving from main chrome roller from the main drive shaft; the shuttle assembly being mounted for back and forth movement thereby to position an incremental width of the web of film traveling over the shuttle rollers in a momentary stationary position as the web of film is moving through the machine so that the incremental width of the film is momentarily stationery relative to the side walls; drive apparatus for moving the shuttle assembly; a perforating and sealing head which is movably mounted relative to the side walls for moving upwardly and downwardly over and relative to the incremental width of the web of film for sealing and perforating the incremental width of the web of film in cooperation with an underlying platen when the incremental width of web is momentarily stationary, thereby to sequentially form bags in the web of film; head drive apparatus for moving the head; and electrical control circuitry for controlling the operation of the shuttle drive apparatus and the head drive apparatus relative to the speed of rotation of the main drive shaft.

16 Claims, 18 Drawing Sheets

(WITHOUT HEAD)

LINE PLASTIC BAG MACHINE

BACKGROUND OF THE INVENTION

1. Field of the Invention

The present invention relates to an in line plastic bag machine through which a web of double ply plastic film or sheet material, e.g. a tubular plastic sheet material, is fed. The web is trained over a shuttle mechanism which reciprocates within the machine beneath a head having at least one heat blade and one perforating blade. The movement of the shuttle is synchronized with the movement of the web so that the head is moved down over a platen while the shuttle is moving thereby to maintain the web momentarily stationary underneath the heat blade and perforating blade as it comes down on the platen with the web of double ply plastic sheet material extending therebetween. More specifically, the present invention relates to control mechanisms in a control system for controlling the speed of the drive rollers of the machine relative to the speed of an upstream web feeding machine. Also, the reciprocating speed of the shuttle is controlled by a control mechanism relative to the speed of the web passing through the machine. Further, the speed of rotation of a secondary drive roller or chrome roller is controlled by a control mechanism to move the web at a speed slightly greater or slightly slower than the speed of the main drive roller or chrome roller. Still further, a control mechanism controls the movement of the head downwardly into engagement with the web and momentarily holding at that position (dwell) for sealing and perforating the double ply web for sequentially forming bags in the web.

2. Description of the Prior Art

Heretofore various machines have been proposed for continuous high speed fabrication of plastic bags. Examples of these previously proposed analogous and non-analogous continuous high speed plastic bag fabricating machines are disclosed in the following analogous and non-analogous U.S. patents:

| U.S. Pat. No. | Patentee |
|---|---|
| 3,994,209 | Jacob |
| 4,003,298 | Schott, Jr. |
| 4,011,978 | Lehmacher et al. |
| 4,077,306 | Wech |
| 5,165,221 | Udelson et al. |
| 5,638,268 | Souza |
| 5,390,875 | Gietman, Jr. et al. |
| 5,660,674 | Saindon et al. |
| 5,738,618 | Lemerand et al. |
| 5,746,043 | Terminella et al. |
| 5,792,306 | Verbeiren |
| 6,004,252 | Blaser |

The Schott Jr. U.S. Pat. No. 4,003,298 is directed to a very early version of the machine described herein.

SUMMARY OF THE INVENTION

According to the present invention there is provided in an in line plastic bag machine comprising: first and second side walls; a plurality of rollers mounted between the side walls for receiving a web of plastic film that is trained through the machine over and around the rollers; a main drive motor; a main drive shaft driven by the main drive motor; the rollers including a main drive or chrome roller and a pair of spaced apart shuttle rollers mounted in a shuttle assembly; a drive train for driving from main chrome roller from the main drive shaft; the shuttle assembly being mounted for back and forth movement thereby to position an incremental width of the web of film traveling over the shuttle rollers in a momentary stationary position as the web of film is moving through the machine so that the incremental width of the film is momentarily stationery relative to the side walls; drive apparatus for moving the shuttle assembly; a perforating and sealing head which is movably mounted relative to the side walls for moving upwardly and downwardly over and relative to the incremental width of the web of film for sealing and perforating the incremental width of the web of film in cooperation with an underlying platen when the incremental width of web is momentarily stationary, thereby to sequentially form bags in the web of film; and head drive apparatus for moving the head; the improvement comprising electrical control circuitry for controlling the operation of the shuttle drive apparatus and the head drive apparatus relative to the speed of rotation of the main drive shaft.

BRIEF DESCRIPTION OF THE DRAWINGS

FIG. 10 is a flow diagram of the protocol, routine or procedure followed by the control circuit after the machine is turned on.

DESCRIPTION OF THE PREFERRED EMBODIMENT(S)

Figure 1:
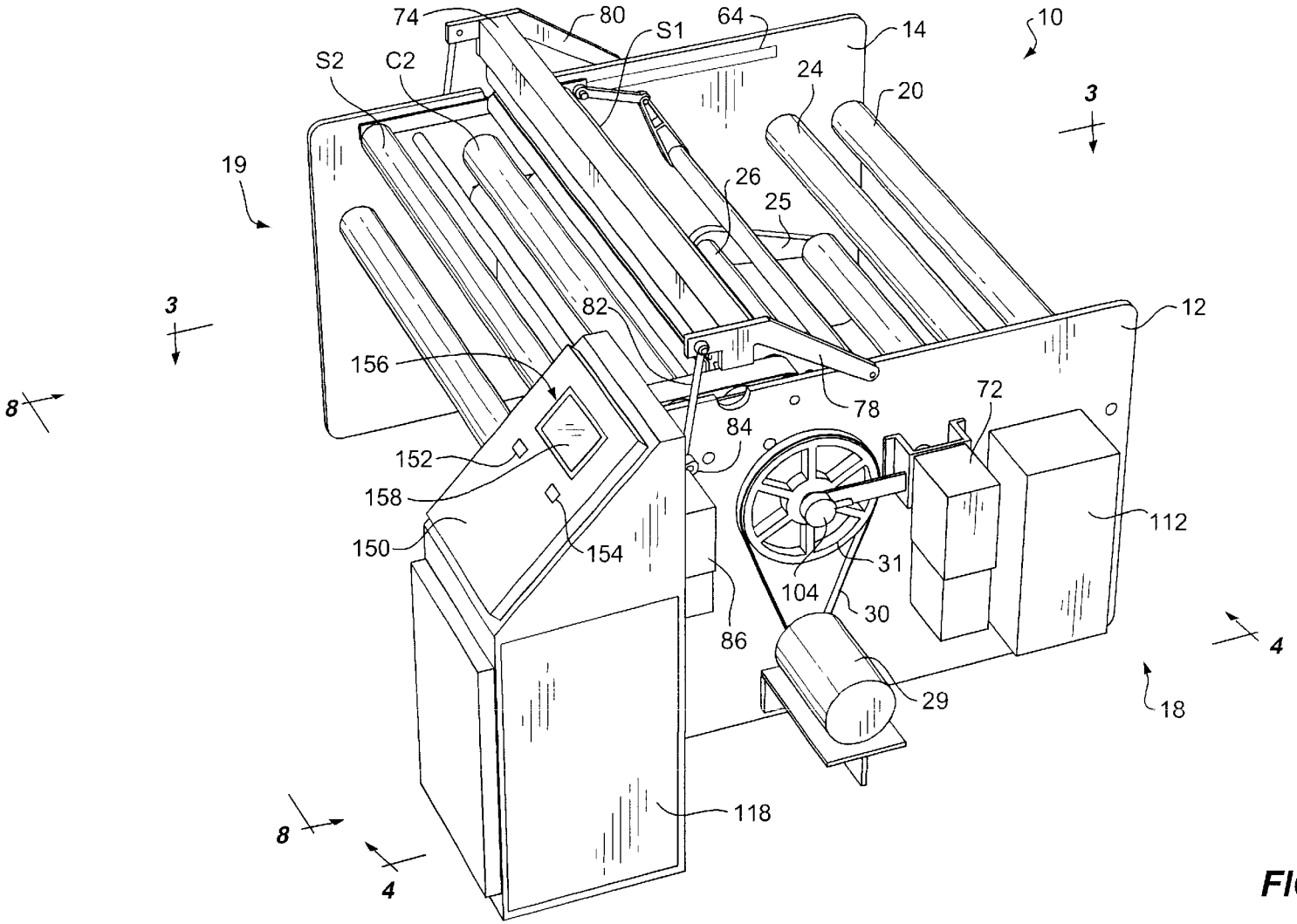
FIG. 1 is a perspective view of the in line plastic bag machine constructed according to the teachings of the present invention viewing the machine from one side, e.g. a left side, thereof.
Figure 2:
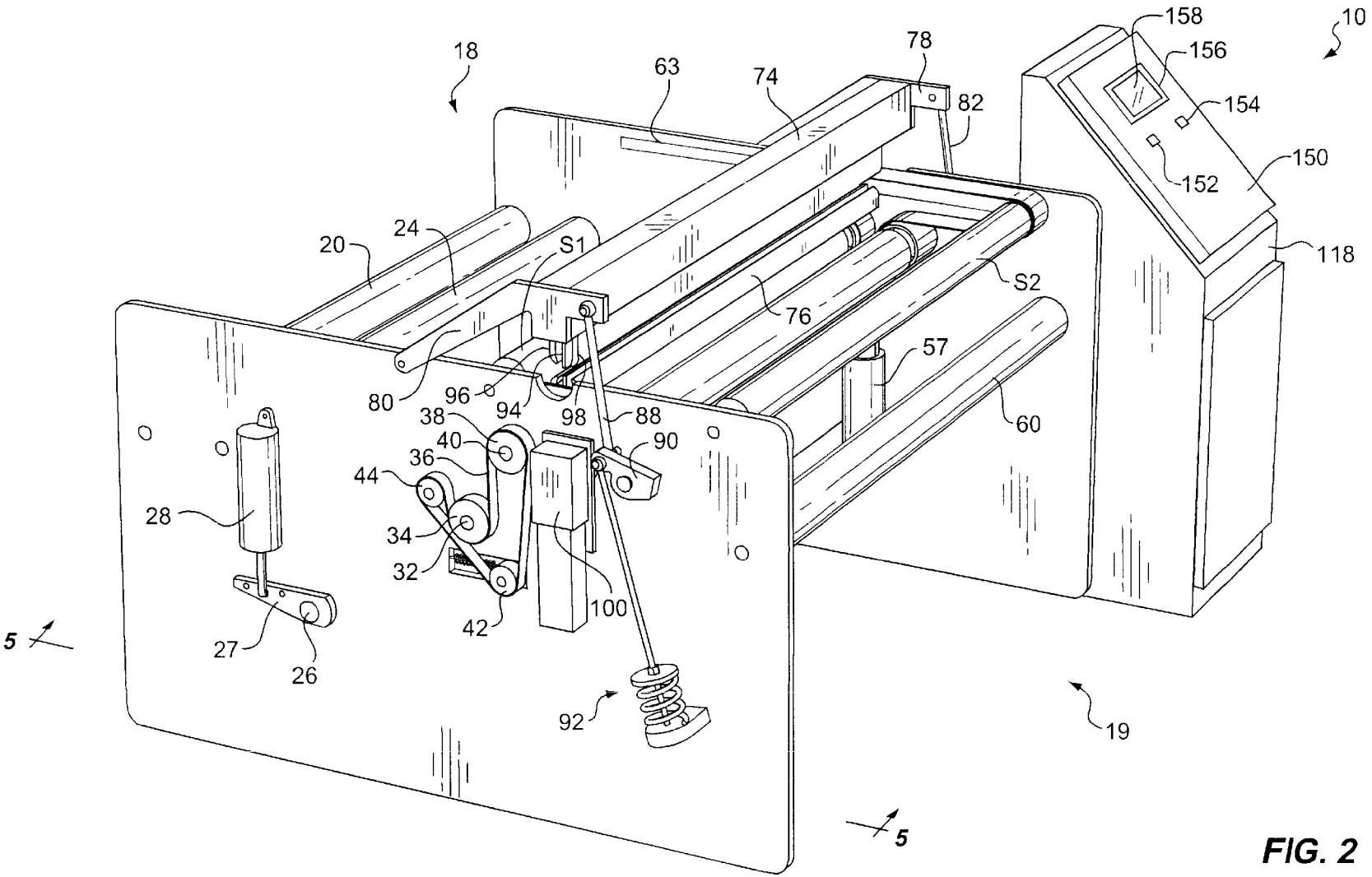
FIG. 2 is a perspective view of the in line plastic bag machine constructed according to the teachings of the present invention viewing the machine from the other side, e.g. a right side, thereof.
Figure 3:
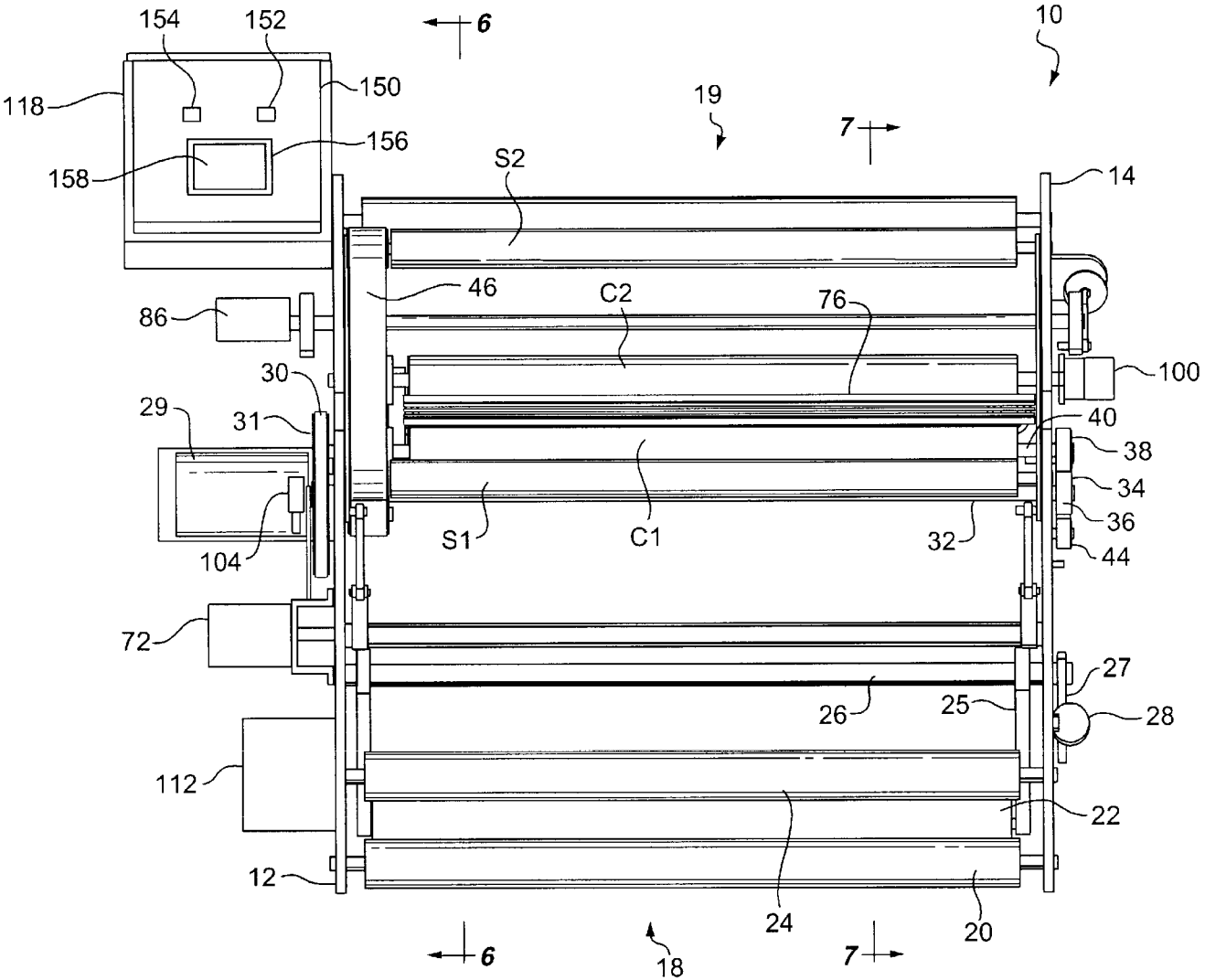
FIG. 3 is a top plan view of the machine shown in FIG. 1 and is taken along line 3—3 of FIG. 1.

Referring now to the drawings in greater detail, there is illustrated in FIGS. 1 and 2, an in line plastic bag machine 10 which is constructed in accordance with the teachings of the present invention and which includes a left wall or plate 12, a right wall or plate 14 and a plurality of rollers, to be described in greater detail hereinafter, mounted between the walls or plates 12 and 14.

Figure 7:
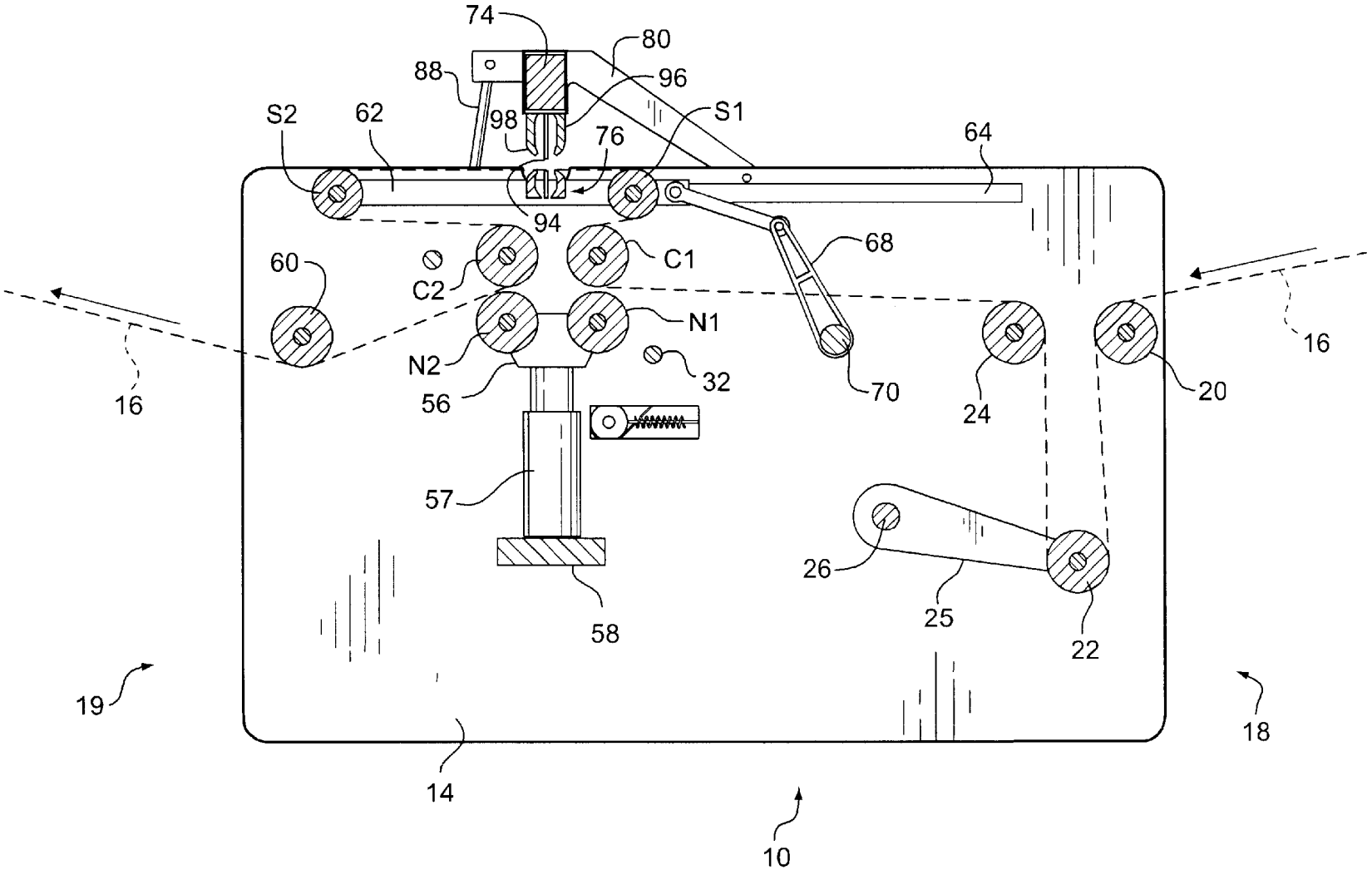
FIG. 7 is a vertical sectional view, front to rear, of the machine shown in FIG. 1, shows in dashed lines the path of a web of two ply plastic sheet or film material through the machine, shows the mechanisms mounted on the inside of the right wall or plate of the machine and is taken along line 7—7 of FIG. 3.
Figure 8:
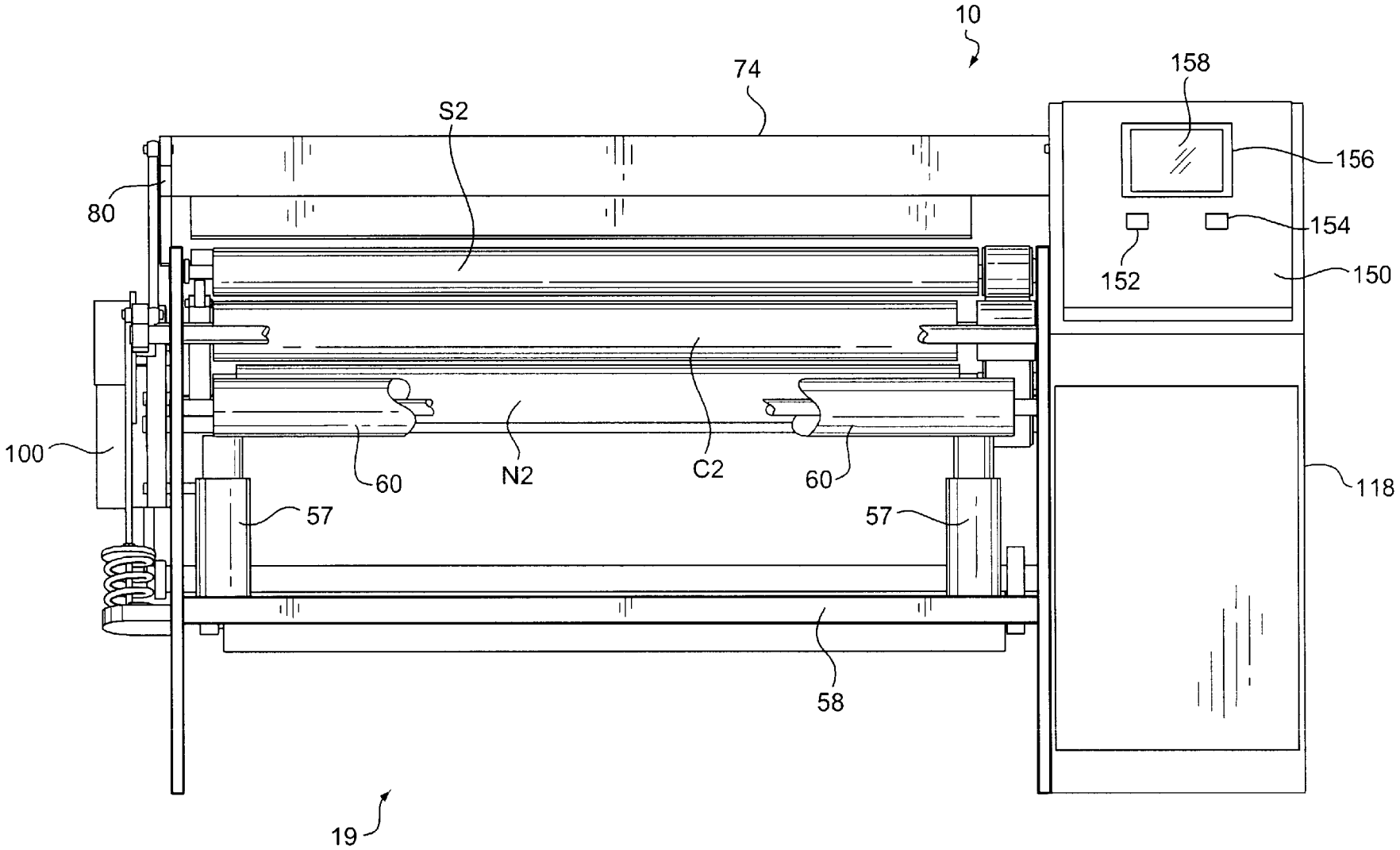
FIG. 8 is a front elevational view of the machine and is taken along line 8—8 of FIG. 1.

As best shown in FIG. 7, a web 16 of a double ply or tubular plastic sheet or film comes into the machine 10 at an entrance end 18 of the machine 10 (on the right hand side of FIG. 1 opposite an exit end 19 of the machine 10 on the left hand side of FIG. 1) and over a first idler roller 20, downwardly to a biased dancer or tensioning roller 22 and then upwardly to a second idler roller 24. As best shown in FIG. 7, the dancer roller 22 is mounted between the outer ends of two pivot arms 25, which are mounted on a shaft 26 within the walls 12 and 14. On the outside of the right plate, a pivot arm 27 is mounted to the shaft 26 and a piston and cylinder mechanism 28 is connected to the pivot arm 27 for rotating the shaft 26, as shown in FIG. 2, so that tension can be applied to the web 16 of plastic film by moving the pivot arm 27 upwardly or downwardly to move the dancer roller 22 at the outer ends of pivot arms 25 upwardly or downwardly.

Then the web 16 is then trained around a first, so called, chrome roller C1 defining a main drive roller C1 of the machine 10. In this respect, and with reference to FIGS. 1, 2, 6 and 7 it will be understood that a main drive motor 29 drives, via a belt 30, a pulley 31 fixed to a main drive shaft 32 which is journalled in and between the walls or plates 12 and 14. Although not shown, it will be understood that some form of tensioning idler roller engages the belt 30 for applying tension to same.

A drive sheave or pulley 34 is mounted on the drive shaft 32 on the outside of the right wall or plate 14 as shown in FIG. 2. Then a reversing drive belt 36 is trained around the drive pulley 34, over a driven sheave or pulley 38 mounted on a shaft 40 mounting the first chrome roller C1, over a tensioning roller 42 mounted on the outside of the right wall or plate 14 and finally over an idler roller 44 mounted on the outside of the right wall or plate 14 and back to the drive pulley 34. In this way the chrome or main drive roller C1 is rotated in a clockwise direction, while the main drive shaft 32 is rotated counterclockwise, viewing the machine as shown in FIGS. 1 and 7.

Figure 6:
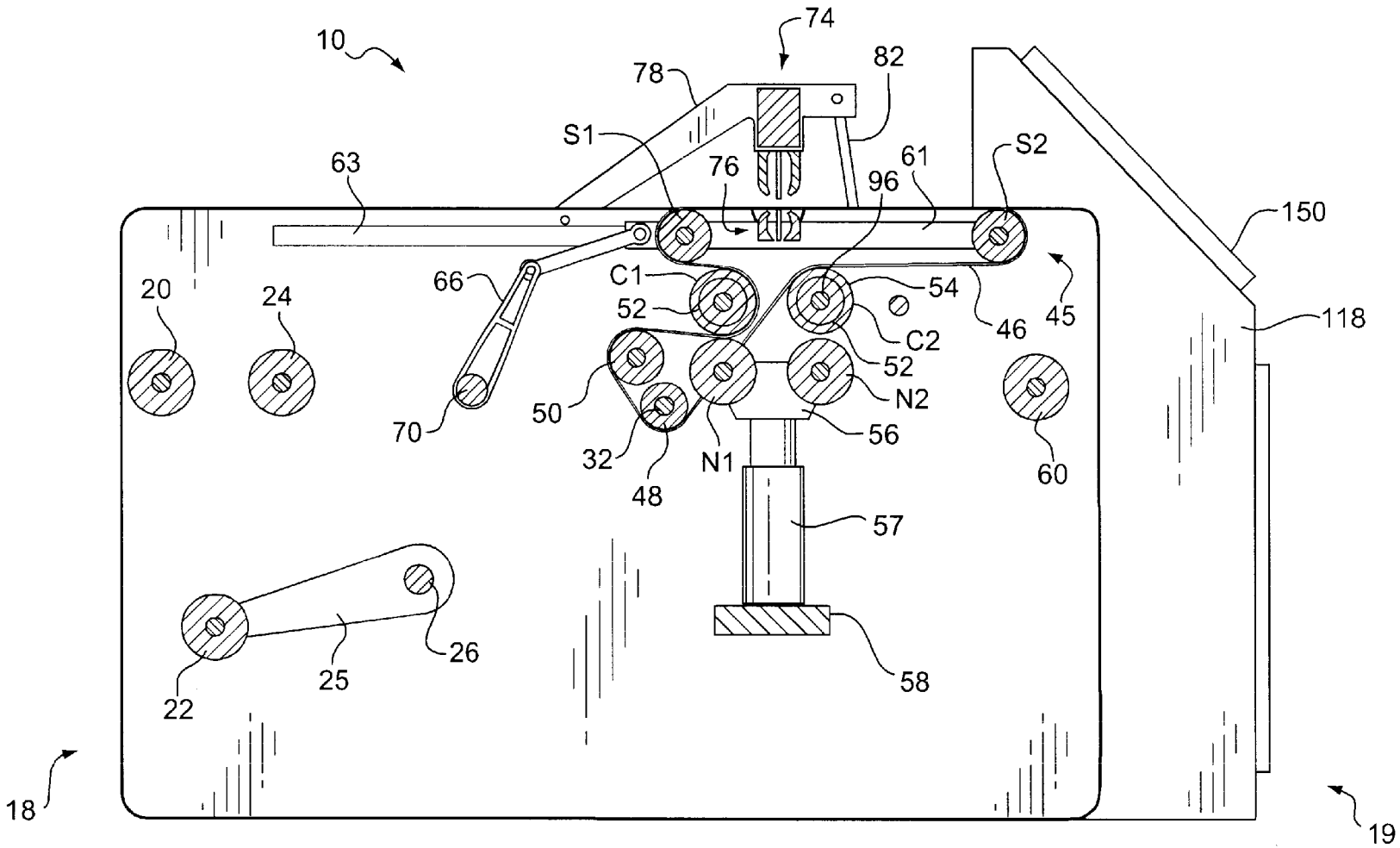
FIG. 6 is a vertical sectional view, rear to front, of the machine shown in FIG. 1, shows the mechanisms mounted on the inside of the left wall or plate of the machine and is taken along line 6—6 of FIG. 3.

At the same time, and as shown in FIG. 6, a pair of shuttle rollers S1 and S2 of a shuttle assembly 45 are driven by a drive belt 46 driven by a pulley 48 fixed on the main drive shaft 32 adjacent the inside of the left wall or plate 12. The belt 46 is then trained over an idler roller idler roller 50, over a freely rotatable short sleeve 52 on the main drive or chrome roller C1, over drive sheaves or pulleys on the shuttle rollers S1 and S2, over a freely rotatable short sleeve 54 on the second chrome roller C2 and then back around the drive pulley 48 adjacent the inside of the left wall 12.

As shown in FIGS. 6 and 7, a pair of nip rollers N1 and N2 are supported on a vertically movable cradle 56 in a cradle post 57 mounted on a cross member or cradle base 58 for being moved pneumatically from a lower position for installing the web 16 in the machine 10 to an upper position shown in the drawings where they engage the chrome or drive rollers C1 and C2, respectively, and assist them in pulling the web 16 through the machine. From a gripped position between the rollers C1 and N1, the web 16 passes around the shuttle rollers S1 and S2 and between the rollers C2 and N2, then under an idler roller 60 and out the exit end 19 of the machine 10.

Figure 4:
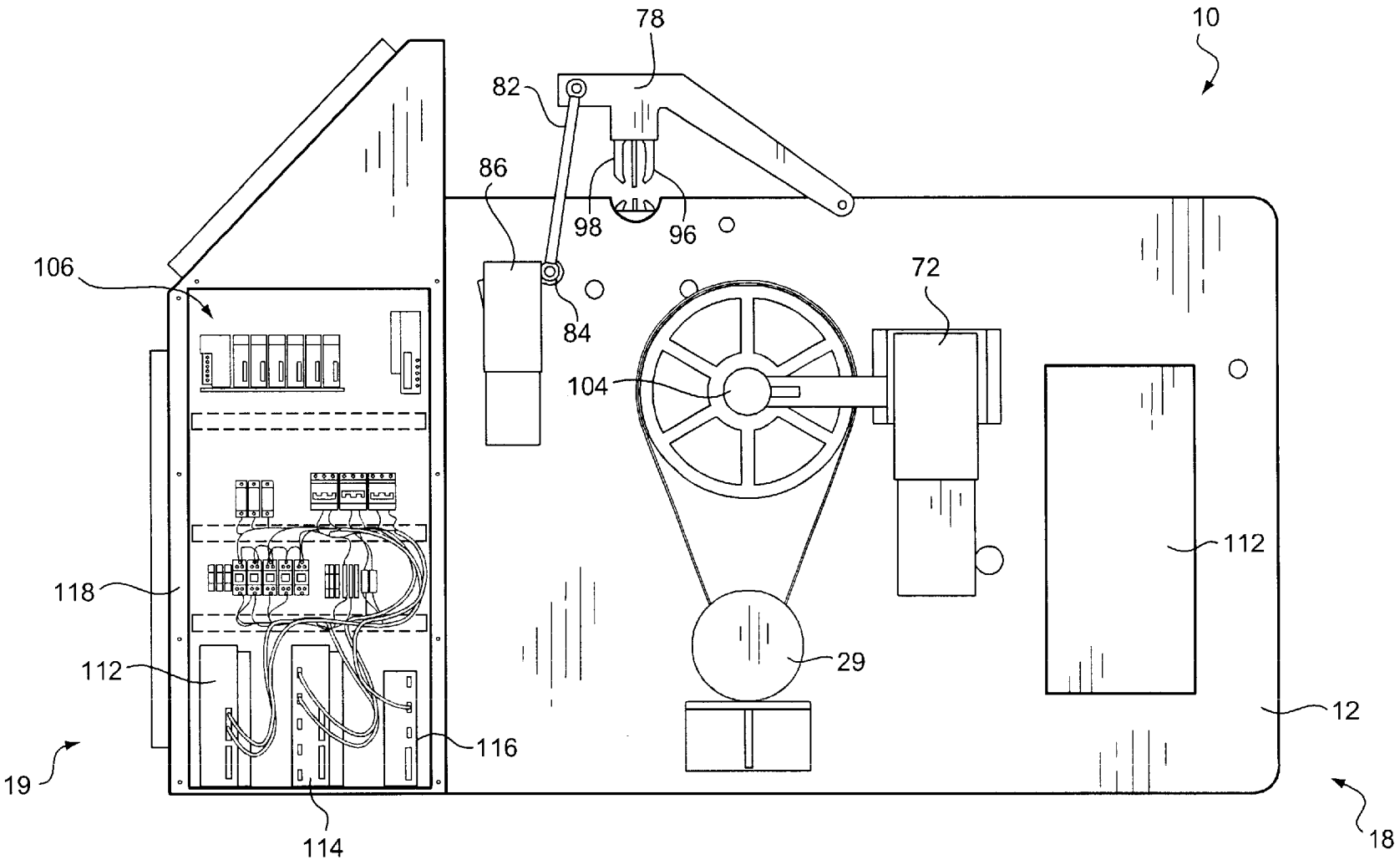
FIG. 4 is a vertical elevational view of the one or left side of the machine, shows the mechanisms mounted on a left wall or plate of the machine and is taken along line 4—4 of FIG. 1.

As shown in FIG. 7, the shuttle assembly 45 includes the two shuttle rollers S1 and S2 which are each journalled at each end in one of two rails 61, 62, each of which is slidably mounted in a track 63 or 64 mounted on the inner surface of the upper margin of one of the walls or plates 12 or 14. An outer end of a linkage 66 or 68 is mounted to one end of each rail 61 or 62. The inner end of each linkage 66 or 68 is mounted to a shaft 70 which is journalled between the walls or plates 12 and 14 and which is stepped by a servo motor 72 mounted on the outside of the left wall or plate 12, as shown in FIGS. 1 and 4, through an arc, clockwise and then counter clockwise to move the rails 61, 62 at a predetermined speed between a home position and a bag forming position. The rails 61, 62 and rollers S1 and S2 form a carriage or shuttle of the shuttle assembly 45 for carrying a section of the moving web 16 including an incremental width of the web 16.

It will be appreciated that, when actuated, the servo motor 72 will move the rails 61, 62 to the right, viewing same as shown in FIGS. 1 and 7, to move the rotating shuttle rollers S1 and S2 toward the entrance end 18 of the machine 10 thereby to keep the web 16 of plastic film, which is traveling around the shuttle rollers S1 and S2, while the shuttle or carriage is moving, substantially stationery relative to a perforating and sealing head 74 and an underlying platen 76.

Figure 5:
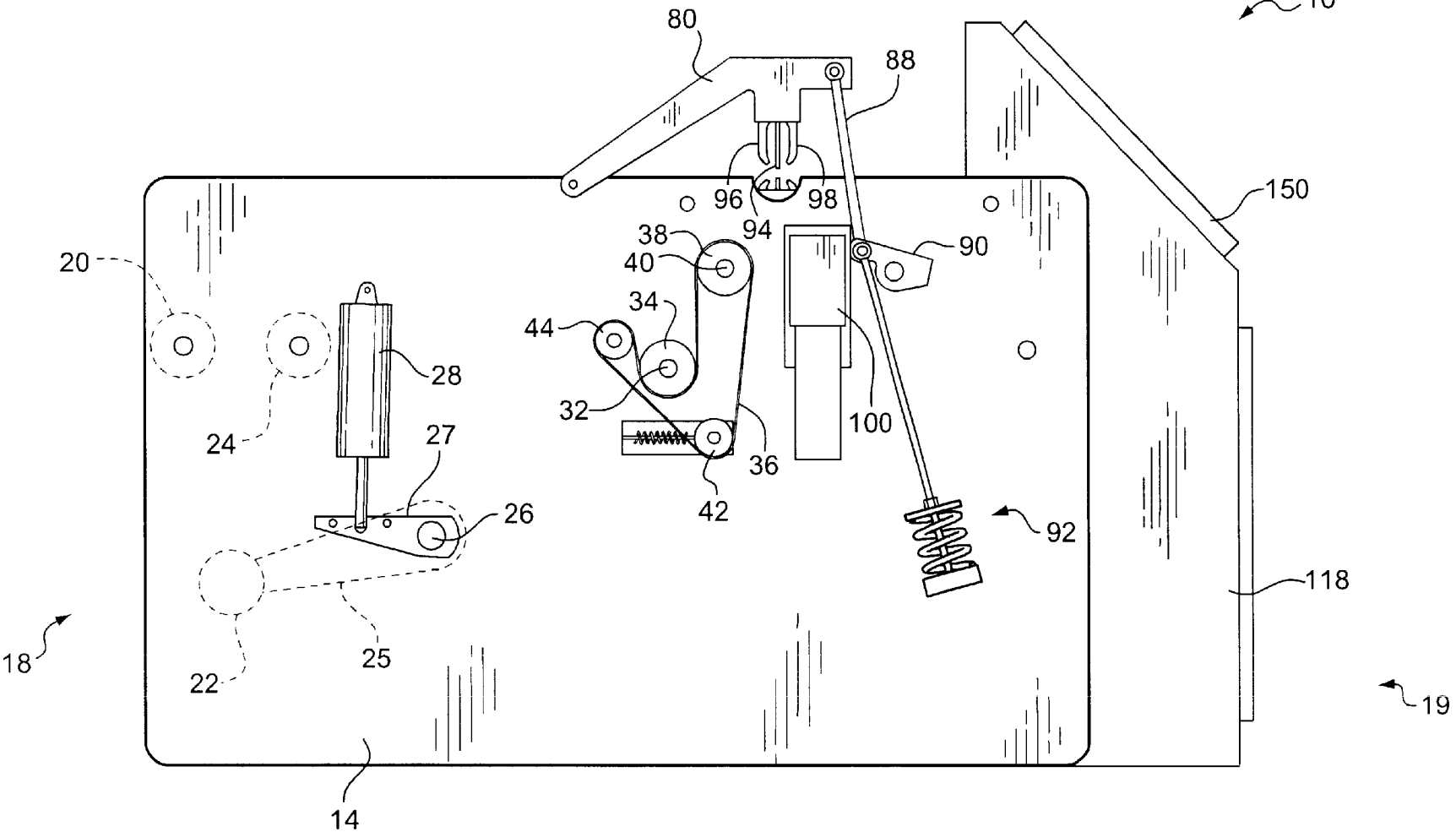
FIG. 5 is a vertical elevational view of the other or right side of the machine, shows the mechanisms mounted on a right wall or plate of the machine and is taken along line 5—5 of FIG. 2.

The head 74 is mounted to pivot arms 78 and 80 which are pivotally mounted at inner ends thereof to, and adjacent respective upper margins of, the left and right walls or plates 12 and 14 of the machine 10. As shown in FIG. 1, the arm 78 is connected to a drive link 82 that is, in turn, connected to an drive arm 84 extending from a drive shaft of a second servo motor 86. On the right hand side of the machine 10 the arm 80 is connected to a link 88 which in turn is connected to arm 90 pivotally mounted on the outer surface of the right wall 14 as shown in FIGS. 2 and 5. The arm 90, in turn, is connected to a spring shock absorber assembly 92 mounted on the outside surface of the right wall 14. It will be understood that when an incremental width of the web 16, defining a desired bag length, is moving between the shuttle rollers S1 and S2, and the shuttle or carriage is being moved by the first servo motor 72, the second servo motor 86 is operated to cause the head 74 to move downwardly to seal and perforate the incremental width of the web 16 to form a separable bag in the web 16.

For this purpose, the head 74 comprises a center discontinuos saw tooth perforating blade 94 which has the configuration of a series of saw teeth or triangles. On either side of the blade 94 is a rear heater blade 96 and a front heater blade 98 for heat sealing the incremental width of the web 16 behind or in front of the transverse line of perforations formed by the perforating blade 94. As shown, the platen 76 has a configuration similar to the configuration of the head 74.

There is also provided in the machine 10, a third servo motor 100 which is mounted on the outside of the right plate or wall 14 as shown in FIGS. 2 and 5. This servo motor 100 has an output drive shaft which is coupled directly to a shaft 102 mounting the second drive or chrome roller C2 and is set to drive the roller C2 at desired speed of rotation, slightly slower than or slightly greater than the speed of rotation of the first drive or chrome roller C1.

As shown in FIGS. 1 and 4, the machine 10 includes a master encoder 104 mounted at one end of the main drive shaft 32. The encoder 104 outputs a predetermined number of pulses for each revolution of the drive shaft 32, typically 1000 pulses per revolution. As will be described in greater detail hereinafter, the pulses are counted and processed by a logic controller 106 in an electrical control circuit 108, shown schematically in FIG. 9. According to the teachings of the present invention, the pulses are fed to the logic controller 106 of the control circuit 108 and to the servo motors 72 and 100. The logic controller 106 can then use the pulse count received for controlling the operation of the machine 10, namely, the firing of the servo motors 72, 86 and 100 at appropriate times while the web 16 is traveling through the machine 10 to make, at high speed, bags, each having a predetermined length.

The electrical control circuit 108 which includes the master encoder 104 and the logic controller 106 controls the main motor 29, the first servo motor 72, the second servo motor 86 and the third servo motor 100. As shown, a main machine drive circuit 110 which is mounted in a cabinet 112 on the outer surface of the left plate 12 as shown in FIG. 1 receives an upstream equipment line signal indicating the speed at which the web 16 of film is being fed to the machine 10 by a web feeding machine, not shown. This signal is used by the main machine drive circuit 110 to set, with the aid of a potentiometer, the speed of the main motor 29 which also supplies an output signal to the master encoder 104 so that the master encoder 104 can make sure there is no slippage in the main drive belt 30 between the output of the motor 29 and the pulley 31.

Three servo motor controllers 112, 114 and 116 are provided and mounted in a console 118, as shown in FIG. 4, wherein the logic controller 106, power supplies, wire conductor buses including an AC wireway and a DC wireway, as well as the three servo motor controllers 112, 114 and 116 are mounted.

Figure 9:
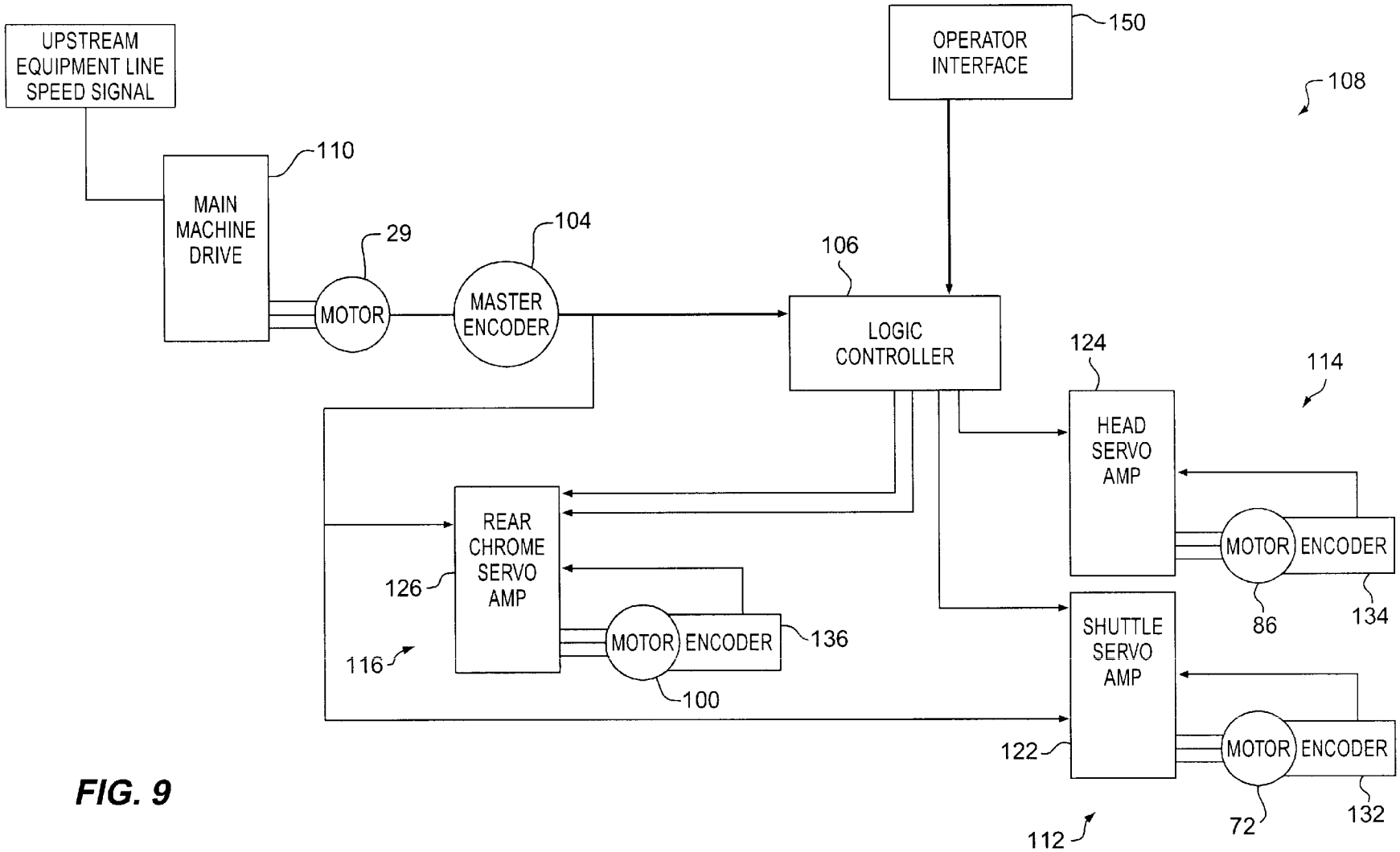
FIG. 9 is a block schematic circuit diagram of the electrical control circuit for the machine shown in FIG. 1.

As shown in FIG. 9, each motor controller 112, 114 and 116 includes a servo amplifier 122, 124 and 126, as shown, as well as an encoder 132, 134 and 136, as shown. Each one of the motor controllers 112, 114 and 116 is also coupled to the logic controller 106, as shown.

The logic controller 106 is also coupled to an operator interface panel 150 which is mounted on the top of the console 118 and includes at least two switches 152 and 154 as well as a visual display 156 including a touch sensitive screen 158 in which touch switches are established for setting operating parameters on the machine 10 or for operating mechanisms of the machine 10 via a sequence of menus which are called up on the screen 158.

In the operation of the machine 10, it will be understood that an operator will first determine the speed of the upstream web feeding equipment from a signal emitted by that equipment which is feeding the web 16 to the machine 10. This signal is then utilized by the main machine drive circuit 110 to set the speed of the motor 29 so that it is commensurate, identical to, or in line with the speed of the web 16 coming into the machine 10.

By utilizing the operator interface panel 150, an operator can then input information regarding the bag length that is desired, the operation of the shuttle assembly 45, the time the head 74 is operated by the servo motor 86 including any advance, retard or dwell times for movement of the head 74 and the time of downward and upward movement of the head 74 for sealing and perforating an incremental width of the web 16.

Also, the operator will make settings for the heat of the heater blade 96 or 98 and for selected which heater blade 96 or 98 is used. Also, the operator will set the speed of the motor 100 to cause a tightening of the web 16 on the shuttle rollers S1 and S2 of the shuttle assembly 45 or loosening of the web 16 on the shuttle rollers S1 and S2 of the shuttle assembly 45, whichever is desired.

Figure 10:
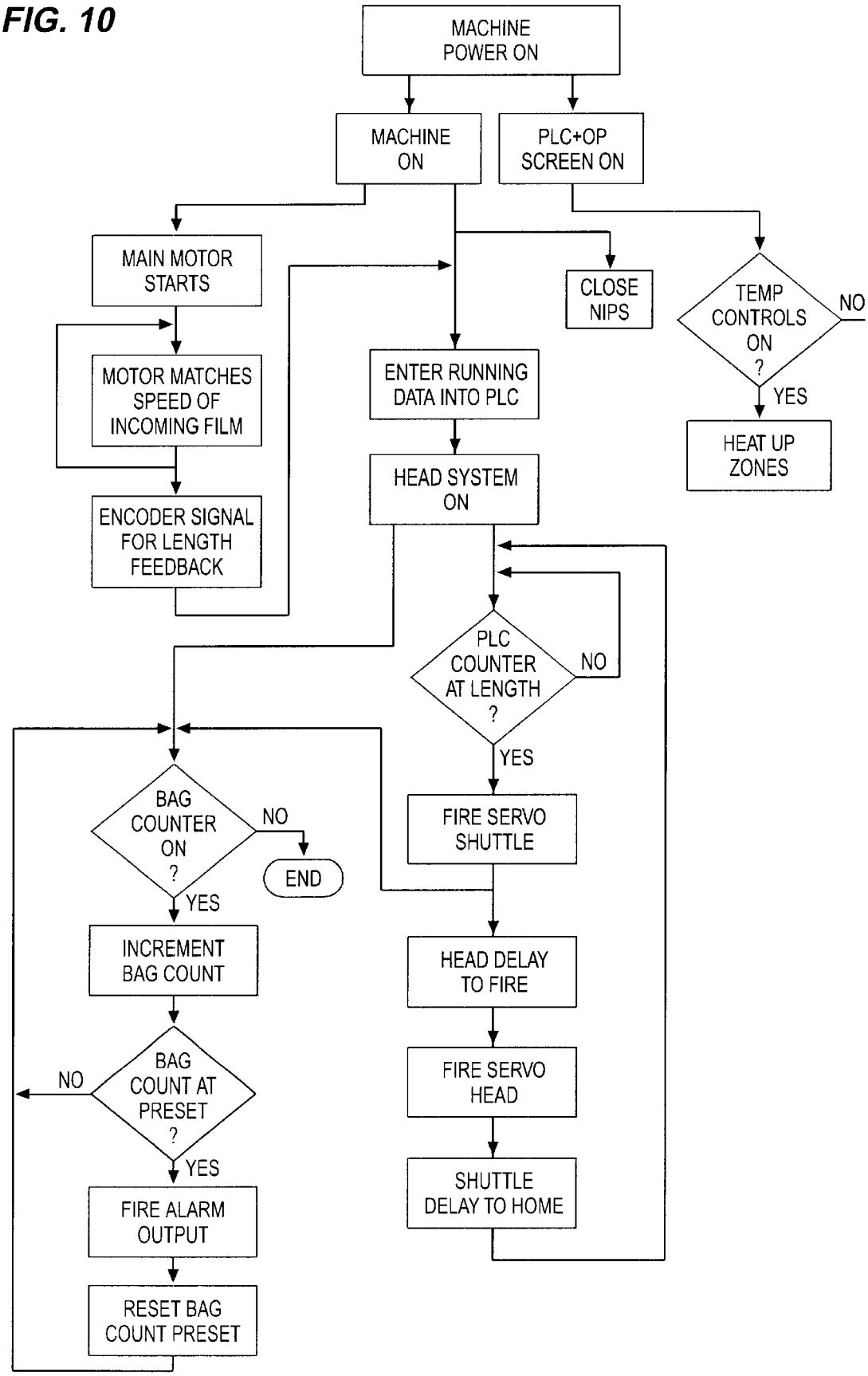

Referring now to FIG. 10, there is illustrated therein a simplified flow chart of the routine, protocol or procedure carried out by the logic controller 106 in conjunction with manual inputs from the operator using the switches 152 and 154 as well as touch switches on the screen 158 of the visual display 156 on the panel 150. In this respect, the switch 152 is utilized to turn the machine on.

Once the machine is on and the logic controller 106 is on, as well as the screen 158 of the visual display 154, an operator can then use the switch 154 to move the nip rollers N1 and N2 to a lower position to enable a web 16 to be inserted into the machine. After the web 16 is fitted into the machine 10, the switch 154 is operated to move the nip rollers N1 and N2 to an upper closed position with the chrome rollers C1 and C2.

As shown on the right hand side of the flow chart, the temperature controls are examined to see if the temperature switch is on. If yes, then the selected heater blade and the temperature of the heater blade 96 or 98 is chosen at the step entitled HEAT UP ZONES.

Then, when the machine is on and the main motor starts, a check is made to make certain that the speed of the main motor 29 matches the speed of the incoming web 16 of film. Then, an encoder signal for length feedback is set and routed back to the main routine where this is entered into the logic controller 106.

Next, the operating parameters of the head 74 is set, such as the timing when the head 74 will be moved up and down and any dwell time for the down position of the head 74. Then it is determined whether the bag counter is on and once it is on an increment bag count is set.

Subsequently, a determination is made that the bag counter is at preset amount. Then, a fire alarm output is checked and the bag count is reset to the preset.

Following the determination that the head operating system is on, the logic controller 106 determines that the bag counter is on and that the bag length is set. Once that is determination is made, the setting of the servo motor 72 for firing the shuttle is set. Then, the head delay for firing servo motor 86 for "head down" is set followed by the setting of the firing time for the servo motor 86 bringing the head 74 down onto the incremental width of the web 16 on the shuttle assembly 45.

Next, a shuttle delay is set.

The menus the operator uses for making the settings outlined in the flow chart shown in FIG. 10 are more readily understood from FIGS. 11–30 which are the menus or displays which appear sequentially on the screen 158.

Figure 11:
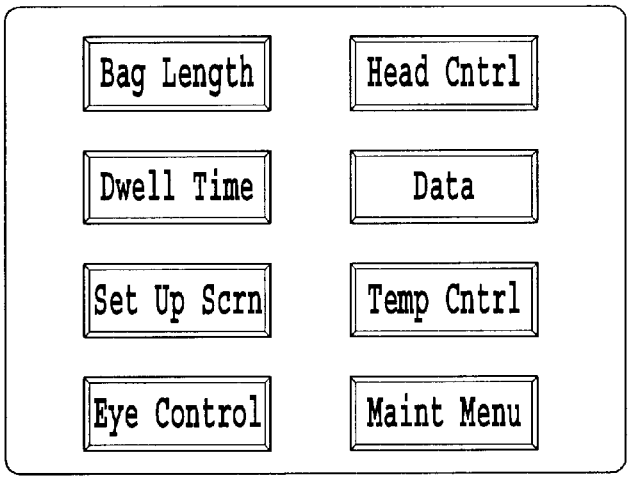
FIGS. 11–34 are plan views of the different displays or menus that are shown on the visual display on a panel of a console of the machine shown in FIGS. 1, 2 and 8.

Referring to FIG. 11, the first menu is a display of the touch switches for bag length, head control, dwell time, set up screen, temperature control, eye control, other data and for returning to the main menu.

Figure 12:
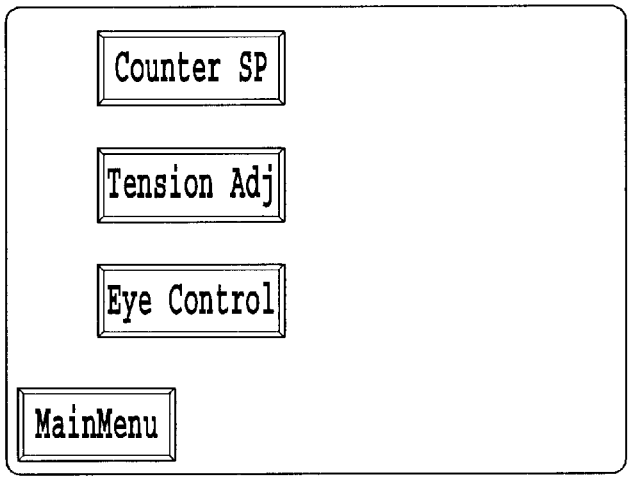

Then, in FIG. 12 is shown a menu for the touch switches in a sub-menu for accessing other display's, e.g. counter speed, tension adjust, etc.

Figure 13:
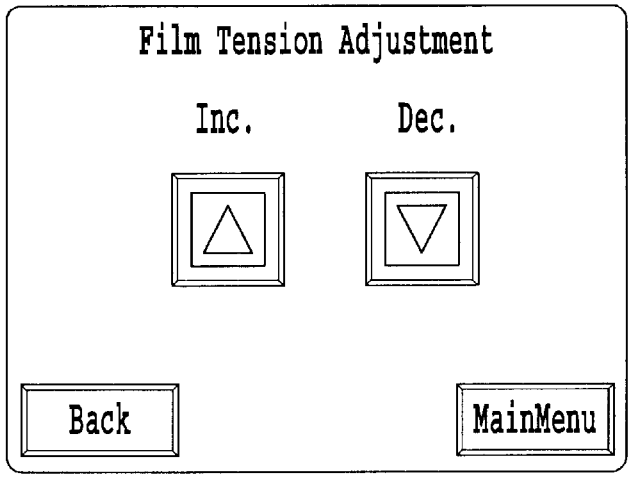

The display of two touch switches in FIG. 13 allows an operator to increase or decrease the tension on the web of film. This is accomplished by changing the speed of the front chrome roller, i.e., the speed ratio of the front to rear chrome rollers.

Figure 14:
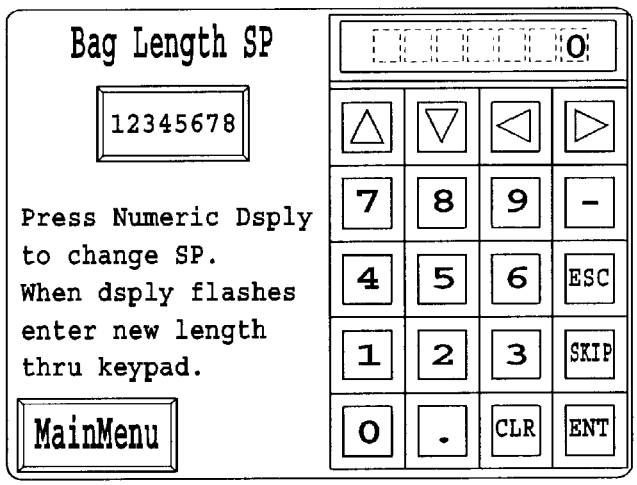

The bag length setting menu is shown in FIG. 14.

Figure 15:
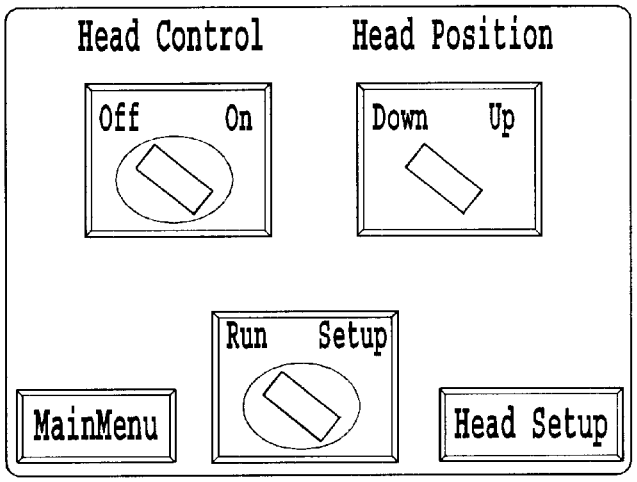

FIG. 15 illustrates the "run setup" screen. When the operator is in this setup screen, he disables the head 74 and adjusts the "head run" position on the "head setup" screen.

Figure 16:
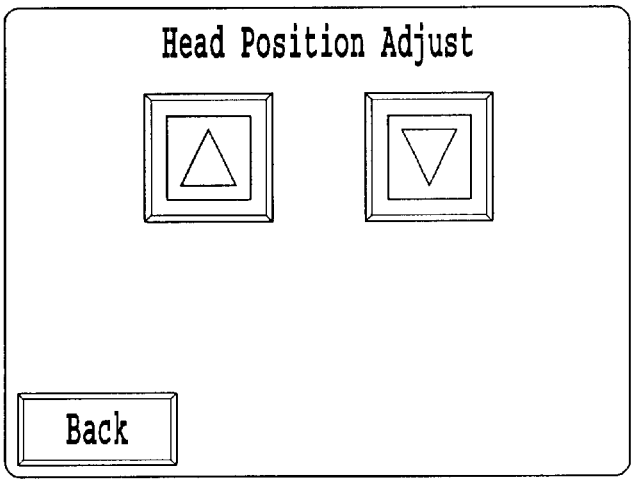

The "head position adjust" screen shown in FIG. 16 allows the operator to adjust the head 74 running position up or down.

Figure 17:
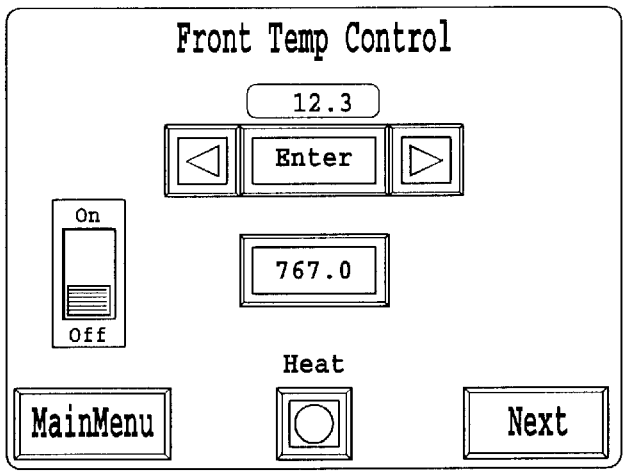

The menu for the front heater blade 98 temperature control setting is shown in FIG. 17.

Figure 18:
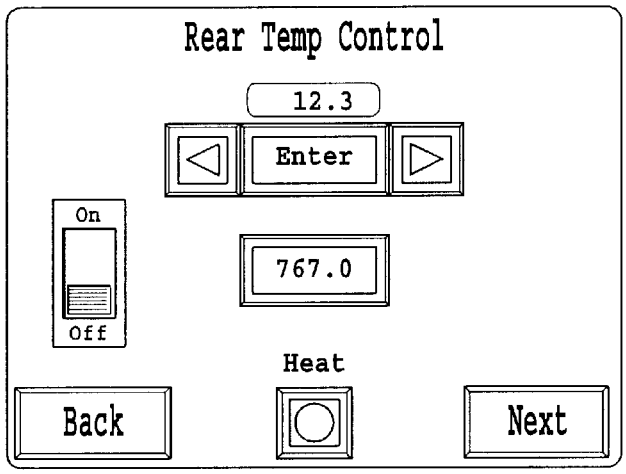

FIG. 18 shows the setting for the rear heater blade 96 temperature control.

Figure 19:
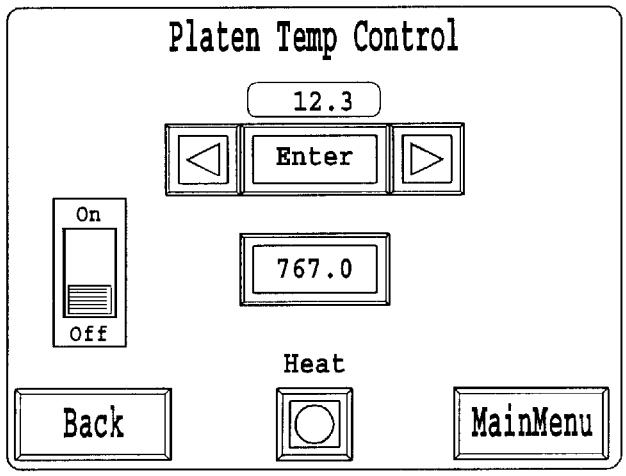

FIG. 19 illustrates the menu for setting the platen 76 temperature.

Figure 20:
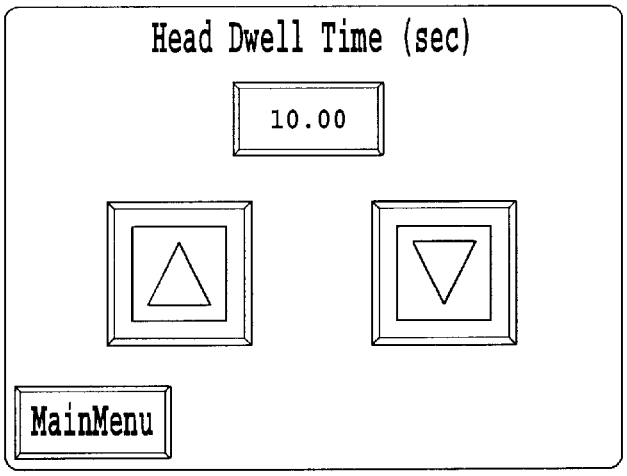

The head dwell time is shown in the menu depicted in FIG. 20 and can be set up or down.

Figure 21:
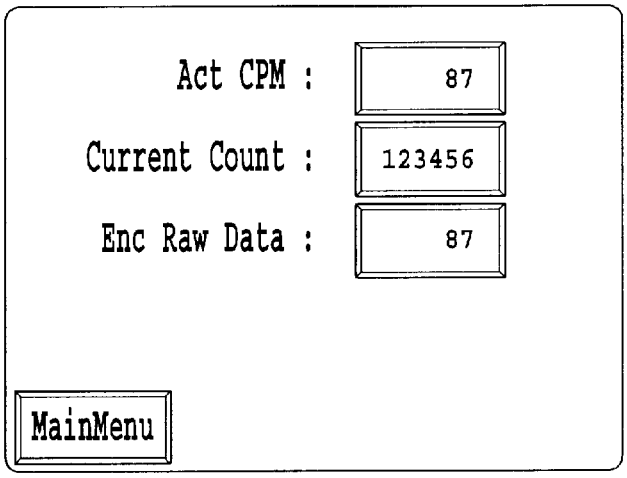

The current bag count is shown in the menu illustrated in FIG. 21.

Figure 22:
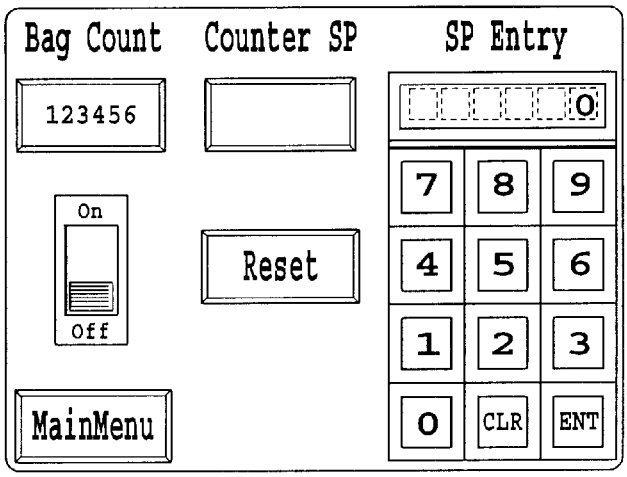

The screen shown in FIG. 22 includes touch switches for setting bag count, bag length and reset.

Figure 23:
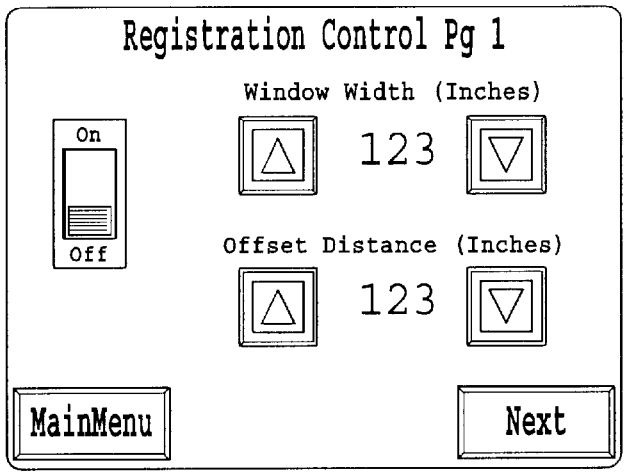

The registration control for the length or width of each bag and offset control for the sealing and cutting is shown in the menu of FIG. 23.

Figure 24:
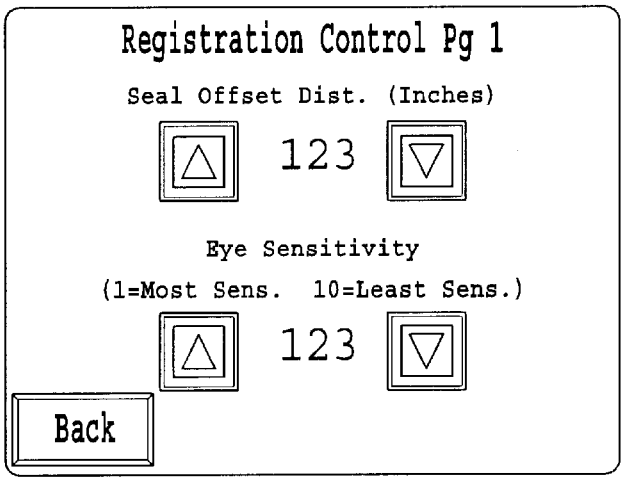

FIG. 24 illustrates the menu for setting a seal offset and for eye sensitivity for sensing registration marks, if any, in the film.

Figure 25:
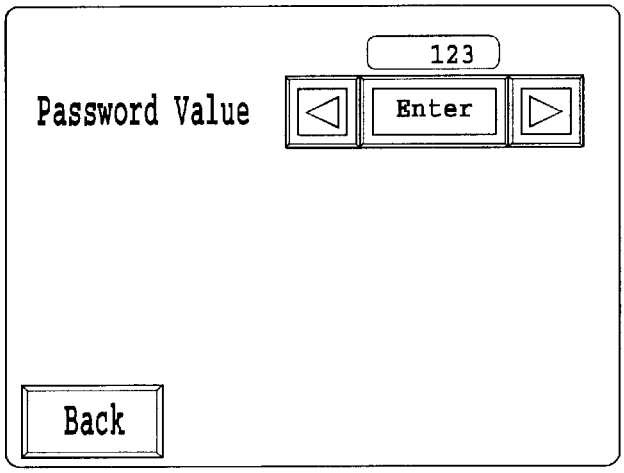

FIG. 25 illustrates a menu for setting a password.

Figure 26:
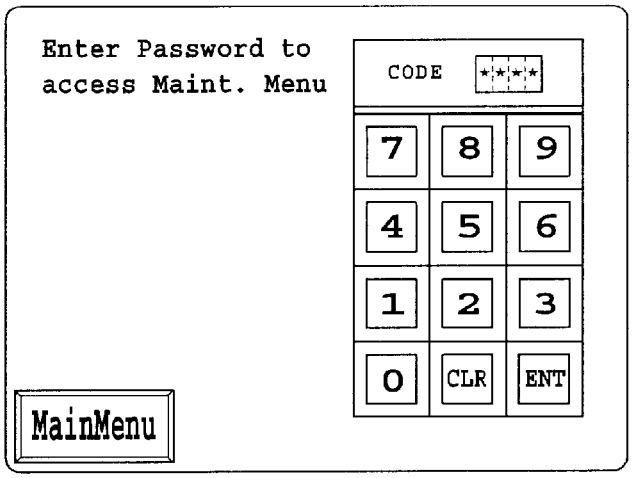

The menu for entering a password is shown in FIG. 26.

Figure 27:
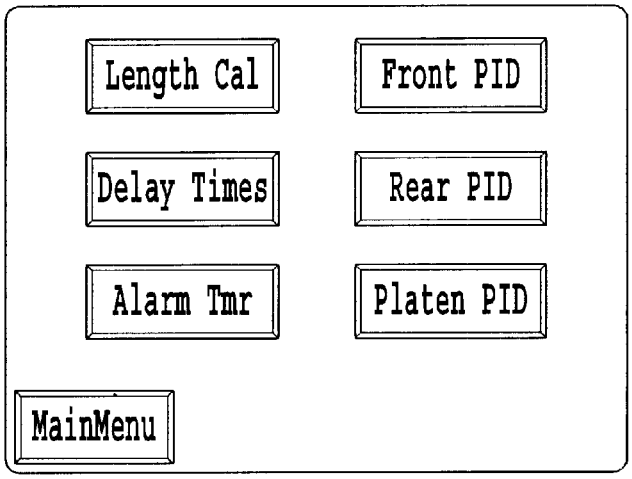

In FIG. 27, there is displayed a menu for the length calibrated, the front heater blade proportional, integral differential, delay times, the rear heater proportional integral differential, and a platen proportional integral differential.

Figure 28:
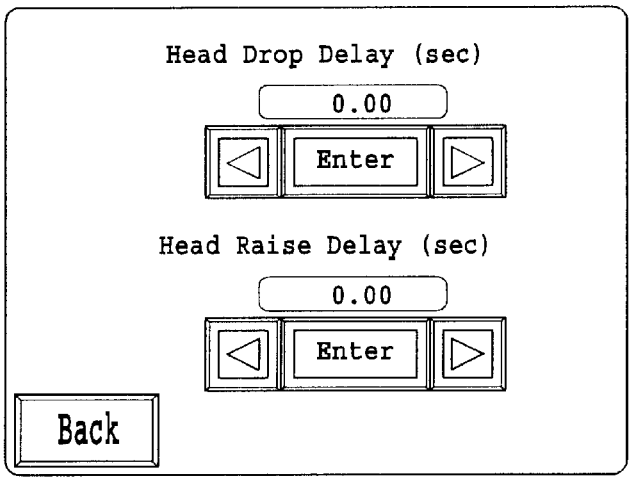

The head drop and head raise delay are shown in the menu displayed in FIG. 28 where the seconds for each can be set.

Figure 29:
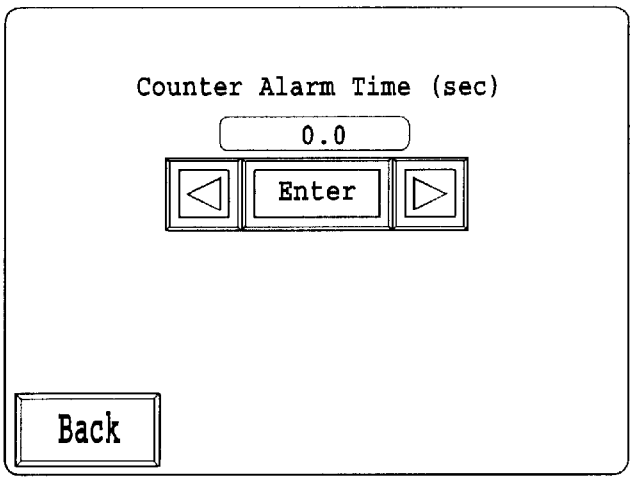

FIG. 29 shows the screen with touch switches for the counter alarm setting.

Figure 30:
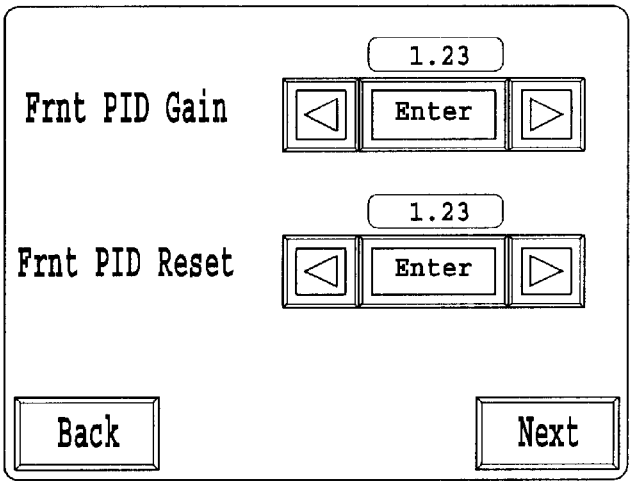

In FIG. 30 there is illustrated a menu of the proportional, integral differential gain and reset which can be entered on the screen 158.

Figure 31:
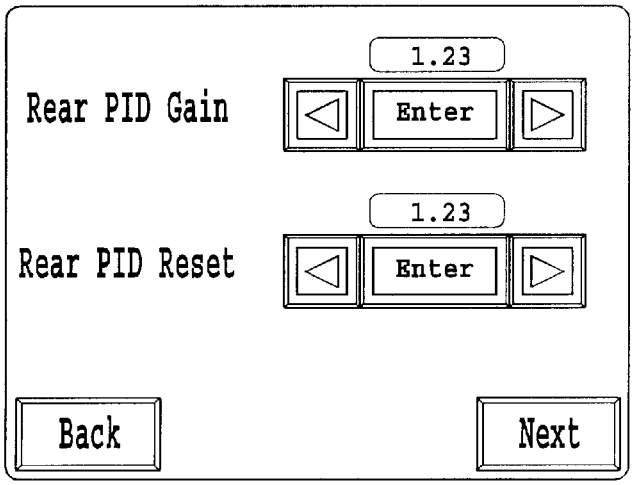

FIG.31 illustrates the screen for setting the proportional integral differential gain and reset for the rear heater blade 96.

Figure 32:
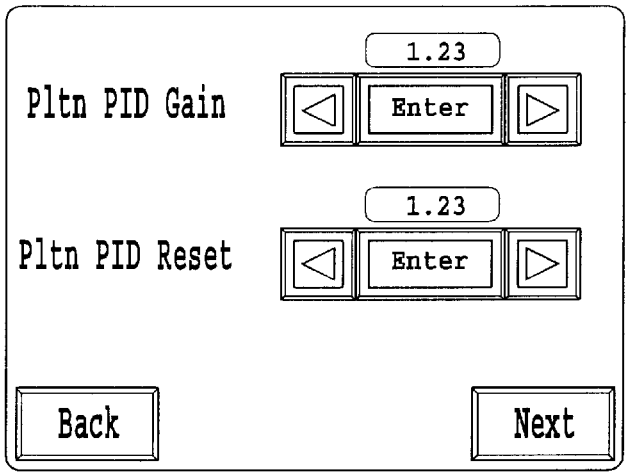

FIG. 32 illustrates the menu for setting the proportional integral differential gain for the platen 76 and for setting the proportional integral differential reset.

Figure 33:
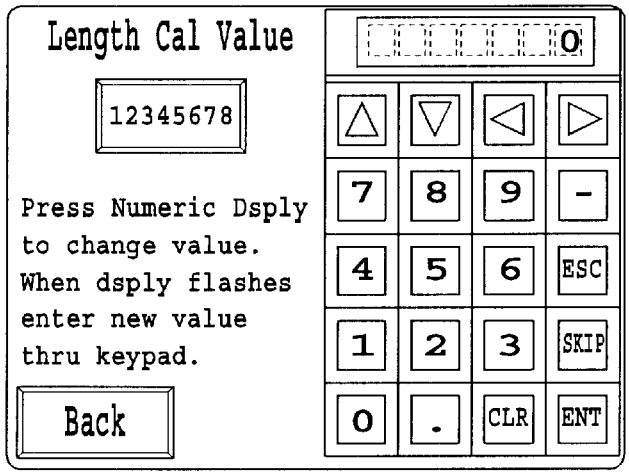

A calibrated length value can be input when the menu shown in FIG. 33 is displayed on the screen 158 of the visual display 156.

Figure 34:
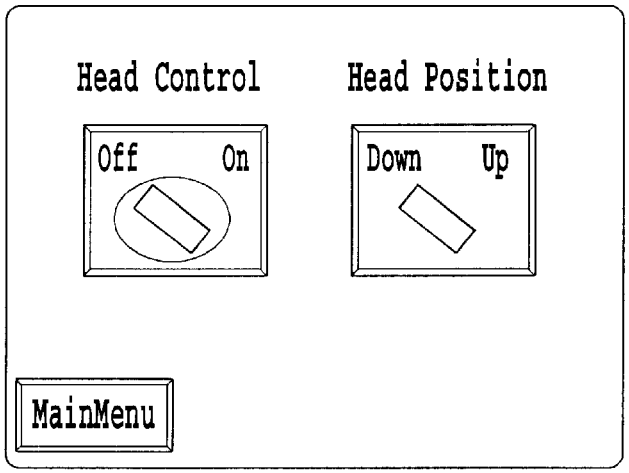

Touch switches for controlling head up or head down are shown in the menu displayed in FIG. 34.

It will be understood that all of these menu displays are called up by an operator in operating the machine 10 utilizing the control panel 150.

From the foregoing description, it will be apparent that the machine 10 of the present invention has a number of advantages, some of which have been described above and others of which are inherent in the invention. For example, the speed of the main motor 29 and of the main drive roller C2 of the machine 10 can be correlated with the speed of the web being fed into the machine 10 by upstream line feeding equipment. Secondly, the electronic control circuit 108 permits close and fine adjustment of the speed of move of the shuttle assembly 45 and the actuation times for moving the shuttle assembly 45 to correlate same with the speed of movement of the web 16 over the shuttle rollers S1 and S2.

Then, the movement of the sealing and perforating head 74 can be accurately controlled, including a dwell time when the head 74 is in the down position, as well as the timing of the downward and upward movement of the head 74. This enables one to make a precise length of bag for each bag formed from the web 16 and an accurate count of the bags formed by the machine 10 is obtained.

Also, the servo motor 100 and the control thereof via the control panel 150 enables an operator to set the speed of the second drive or chrome roller C1 for enabling one to construct a bag having desired characteristics by having a floppy section of film 16 extending over the shuttle rollers S1 and S2 or by having a taut section of film 16 trained over the shuttle rollers S1 and S2 when the head 74 is operated to form a bag end.

Additionally, the drive belt 36 and the arrangement of the pulleys 34, 38, 42 and 44 provides a simple way of reversing the direction of rotation of the main drive roller C1 relative to the rotation of the main drive shaft 32.

Also, it will be understood that modifications can be made to the machine 10 of the present invention and to the electrical control circuitry 108 thereof without departing from the teachings of the invention. Accordingly, the scope of the invention is only to be limited as necessitated by the accompanying claims.

I claim:

1. In an in line plastic bag machine comprising:

first and second side walls;

a plurality of rollers mounted between the side walls for receiving a web of plastic film that is trained through the machine over and around the rollers;

a main drive motor;

a main drive shaft driven by said main drive motor;

said rollers including a main drive roller and a pair of spaced apart shuttle rollers mounted in a shuttle assembly;

drive means for driving said main roller from said main drive shaft;

said shuttle assembly being mounted for back and forth movement thereby to position an incremental width of the web of film traveling over the shuttle rollers in a momentary stationary position as the web of film is moving through the machine so that the incremental width of the film is momentarily stationery relative to the side walls;

drive means for moving said shuttle assembly;

a perforating and sealing head which is movably mounted relative to said side walls for moving upwardly and downwardly over and relative to the incremental width of the web of film for sealing and perforating the incremental width of the web of film in cooperation with an underlying platen when the incremental width of web is momentarily stationary, thereby to sequentially form bags in the web of film; and, head drive means for moving the head;

the improvement comprising:

electrical control circuit for controlling the operation of the shuttle drive means and the head drive means relative to the speed of rotation of the main drive shaft, said electric control circuit including a master encoder mounted at one end of said main drive shaft for outputting a predetermined number of pulses for each revolution of the drive, said shuttle drive means comprising a servo motor connected to an output shaft which is connected by linkage to said shuttle assembly and said electrical circuit including logic circuitry for driving said output shaft through a predetermined arc at a predetermined speed as determined by the pulse count received from said master encoder thereby to control the time of movement and speed of movement of said shuttle assembly thereby to maintain the incremental width of the web of film stationary momentarily beneath said sealing and perforating head.

2. The in line bag machine of claim 1 wherein said predetermined number of pulses is 1,000.

3. The in line bag machine of claim 1 wherein said drive means for driving said main roller includes a drive pulley on said main drive shaft, a driven pulley on a shaft for said main roller, at least two idler pulleys and a drive belt arranged around said pulleys for rotating said main roller in a direction of rotation opposite the direction of rotation of said main drive shaft.

4. The in line bag machine of claim 3 wherein one of said idler rollers is a tensioning roller.

5. The in line bag machine of claim 1 wherein said electrical control circuit includes an operator input panel having an ON/OFF switch for said machine and a visual display including a touch sensitive display screen for displaying operating parameters of the machine and for enabling an operator to input and change operating parameters.

6. The in line bag machine of claim 5 wherein said electrical control circuit is constructed and arranged to display a series of menus on said touch sensitive screen.

7. The in line bag machine of claim 6 wherein said head has a heater blade and said menus include a menu for inputting a temperature setting for said heater blade.

8. The in line bag machine of claim 7 wherein said menus include a menu for setting the dwell time when said head is in engagement with the incremental width of the web.

9. The in line bag machine of claim 6 wherein said head has a forward heater blade and a rearward heater blade on opposite sides of a center perforating blade and said menus include menus for selecting a heater blade and for setting the operating temperature of the selected heater blade.

10. The in line bag machine of claim 6 wherein said menus include a menu for setting the bag length.

11. The in line bag machine of claim 6 wherein said menus include a menu for setting the speed of a second roller relative to the speed of the main roller.

12. The in line bag machine of claim 5 wherein said electrical control circuit includes a potentiometer for setting the speed of the main motor relative to a signal received from upstream equipment indicative of the speed of movement of an upstream web feeding machine.

13. The in line bag machine of claim 1 wherein said machine includes at least one nip roller which is movable on a cradle upwardly and downwardly beneath said main roller, said cradle being pneumatically movable on a cradle post and said control panel includes a control switch for moving said nip roller to a lower position where the web of film can be mounted in the machine to an upper position where the nip roller collaborates with said main roller for gripping and moving the web of film.

14. The in line bag machine of claim 13 wherein said machine includes a second roller rotatable at a speed slightly greater than or slightly less than the speed of rotation of said main roller and said cradle mounts a second nip roller which is movable between a lower position where the web can be mounted in said machine and an upper position wherein said nip roller collaborates with said second roller for gripping and moving the web through said machine.

15. In an in line plastic bag machine comprising;

first and second side walls;

a plurality of rollers mounted between the side walls for receiving a web of plastic film that is trained through the machine over and around the rollers;

a main drive motor;

a main drive shaft driven by said main drive motor;

said rollers including a main drive roller and a pair of spaced apart shuttle rollers mounted in a shuttle assembly;

drive means for driving said main roller from said main drive shaft;

said shuttle assembly being mounted for back and forth movement thereby to position an incremental width of the web of film traveling over the shuttle rollers in a momentary stationary position as the web of film is moving through the machine so that the incremental width of the film is momentarily stationery relative to the side walls;

drive means for moving said shuttle assembly;

a perforating and sealing head which is movably mounted relative to said side walls for moving upwardly and downwardly over and relative to the incremental width of the web of film for sealing and perforating the incremental width of the web of film in cooperation with an underlying platen when the incremental width of web is momentarily stationary, thereby to sequentially form bags in the web of film; and, head drive means for moving the head;

the improvement comprising:

an electrical control circuit for controlling the operation of the shuttle drive means and the head drive means relative to the speed of rotation of the main drive shaft, said electric control circuit including a master encoder mounted at one end of said main drive shaft for outputting a predetermined number of pulses for each revolution of the drive, and said head being pivotally mounted to and between said side walls and said head drive means including a servo motor connected by linkage to said sealing and perforating head and said electrical control circuit further including logic circuitry for controlling the operation of the servo motor for causing the downward and upward movement of said head and for controlling the dwell time of the head in the lower position relative to the pulse count received from said master encoder.

16. In an in line plastic bag machine comprising:

first and second side walls;

a plurality of rollers mounted between the side walls for receiving a web of plastic film that is trained through the machine over and around the rollers;

a main drive motor;

a main drive shaft driven by said main drive motor;

said rollers including a main drive roller and a pair of spaced apart shuttle rollers mounted in a shuttle assembly;

drive means for driving said main roller from said main drive shaft;

said shuttle assembly being mounted for back and forth movement thereby to position an incremental width of the web of film traveling over the shuttle rollers in a momentary stationary position as the web of film is moving through the machine so that the incremental width of the film is momentarily stationery relative to the side walls;

drive means for moving said shuttle assembly;

a perforating and sealing head which is movably mounted relative to said side walls for moving upwardly and downwardly over and relative to the incremental width of the web of film for sealing and perforating the incremental width of the web of film in cooperation with an underlying platen when the incremental width of web is momentarily stationary, thereby to sequentially form bags in the web of film; and, head drive means for moving the head;

the improvement comprising:

an electrical control circuit for controlling the operation of the shuttle drive means and the head drive means relative to the speed of rotation of the main drive shaft, said electric control circuit including a master encoder mounted at one end of said main drive shaft for outputting a predetermined number of pulses for each revolution of the drive, and said machine including a second roller and a servo motor having an output shaft coupled to said second roller and said electrical control circuit including logic circuitry for driving said servo motor relative to the pulse count received for causing said servo motor to rotate said second roller at a speed of rotation slightly faster or slightly slower than the speed of rotation of said main drive shaft.

* * * * *